US006226960B1

(12) United States Patent
Focke et al.

(10) Patent No.: US 6,226,960 B1
(45) Date of Patent: May 8, 2001

(54) METHOD OF, AND APPARATUS FOR, CLEANING PACKAGING MACHINES

(75) Inventors: Heinz Focke, Verden; Irmin Steinkamp, Seevetal, both of (DE)

(73) Assignee: Foche & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/329,220

(22) Filed: Jun. 10, 1999

(30) Foreign Application Priority Data

Jun. 11, 1998 (DE) ..... 198 25 943

(51) Int. Cl.[7] ..... B65B 49/00

(52) U.S. Cl. ..... 53/234; 53/167; 53/393; 53/396

(58) Field of Search ..... 53/234, 167, 393, 53/396; 198/494, 469.1, 470.1; 15/104.93, 118, 210.1, 104.002, 105; 134/6; 493/910

(56) References Cited

U.S. PATENT DOCUMENTS

| | | | | |
|---|---|---|---|---|
| 3,069,815 | * | 12/1962 | Valentine | 15/118 |
| 4,330,976 | * | 5/1982 | Blackall et al. | 53/234 |
| 4,735,032 | | 4/1988 | Focke | 53/149 |
| 4,750,607 | | 6/1988 | Focke | 198/792 |
| 5,148,572 | * | 9/1992 | Wells et al. | 15/118 |
| 5,227,844 | | 7/1993 | Bhattacharjee et al. | 15/104.93 |
| 5,536,328 | | 7/1996 | Morgavi | 134/6 |
| 5,544,467 | | 8/1996 | Focke | 53/387.2 |

FOREIGN PATENT DOCUMENTS

| | | |
|---|---|---|
| 43 34 745 | 4/1995 | (DE) . |
| 196 30 376 | 2/1998 | (DE) . |
| 197 19 198 | 11/1998 | (DE) . |
| 719518 | 7/1996 | (EP) . |
| 761 539 | 3/1997 | (EP) . |
| 839 719 | 5/1998 | (EP) . |

* cited by examiner

*Primary Examiner*—Stephen F. Gerrity
*Assistant Examiner*—Sam Tawfik
(74) *Attorney, Agent, or Firm*—Sughrue, Mion, Zinn, Macpeak & Seas, PLLC

(57) ABSTRACT

Method of cleaning packaging machines, in particular cigarette packaging machines, with the aid of cleaning bodies (22) which are directed through the packaging machine instead of pack contents and packaging material. The cleaning bodies (22) are thus configured and dimensioned in approximately the same way as the pack contents—cigarette group—or pack.

9 Claims, 7 Drawing Sheets

10
17
39
40
37
35
36
15
15
38
35
35

METHOD OF, AND APPARATUS FOR, CLEANING PACKAGING MACHINES

BACKGROUND OF THE INVENTION

The invention relates to a method of cleaning packaging machines, in particular cigarette packaging machines, which have conveying devices, folding subassemblies, in particular folding turrets, pack dryers, in particular drying turrets, and other devices, it being the case that pack contents—cigarette group—and blanks of packaging material run through the packaging machine for the purpose of producing packs. The invention also relates to a packaging machine and cleaning devices.

In the case of high-capacity packaging machines, in particular cigarette packaging machines, the cleaning which is necessary poses a particular problem. Stoppage times of the packaging machine result in considerable reductions in production. Added to this is the fact that, for many subassemblies, devices, etc. of the complex packaging machine, (manual) cleaning cannot be carried out sufficiently, if at all.

SUMMARY OF THE INVENTION

The object of the invention is to propose measures for effective cleaning of a packaging machine without adversely affecting the operating sequences to any great extent.

In order to achieve this object, it is proposed according to the invention that, instead of the pack contents—cigarette group—and/or the packaging material, cleaning devices or cleaning elements be conveyed through the packaging machine.

The invention is based on the finding that contaminants occur, in particular, in those regions and/or on those devices which are in contact with the packs, the pack contents or the packaging material during production of the packs. The solution to the problem according to the invention thus makes provision to convey through the packaging machine devices, elements or bodies which are dimensioned a manner corresponding to a pack, the pack contents or packaging material. The relevant cleaning devices thus come into contact with the machine devices and elements which are involved in the process for producing the packs. On account of appropriate configuration or pre-treatment of the cleaning elements, the relevant machine parts are automatically cleaned as a result of the cleaning elements running through.

In the case of cigarette packaging machines, the cleaning bodies or elements may be cuboidal bodies of the dimensions of a cigarette block (cigarette group wrapped in an inner blank) or of a cigarette pack. Furthermore, according to the invention, it is possible for blanks of paper or paper-like materials with cleaning properties to be directed through the packaging machine, to be precise in particular together with the (cuboidal) cleaning bodies. These are treated, within the packaging machine, in the same way as the packs or the packaging material, the one exception being constituted by any glue subassemblies, which are brought to a standstill during this cleaning phase.

According to a further proposal of the invention, the packaging machines themselves are geared towards the cleaning process, for example by virtue of the installation of subassemblies for treating the cleaning material or the cleaning bodies. For example, it is possible for the latter, as they are being fed to a folding turret, to be impregnated or coated with an active cleaning agent.

BRIEF DESCRIPTION OF THE DRAWINGS

Further details of the invention are explained in more detail hereinbelow with reference to the drawings, in which.

DETAILED DESCRIPTION OF THE INVENTION

Figure 1:
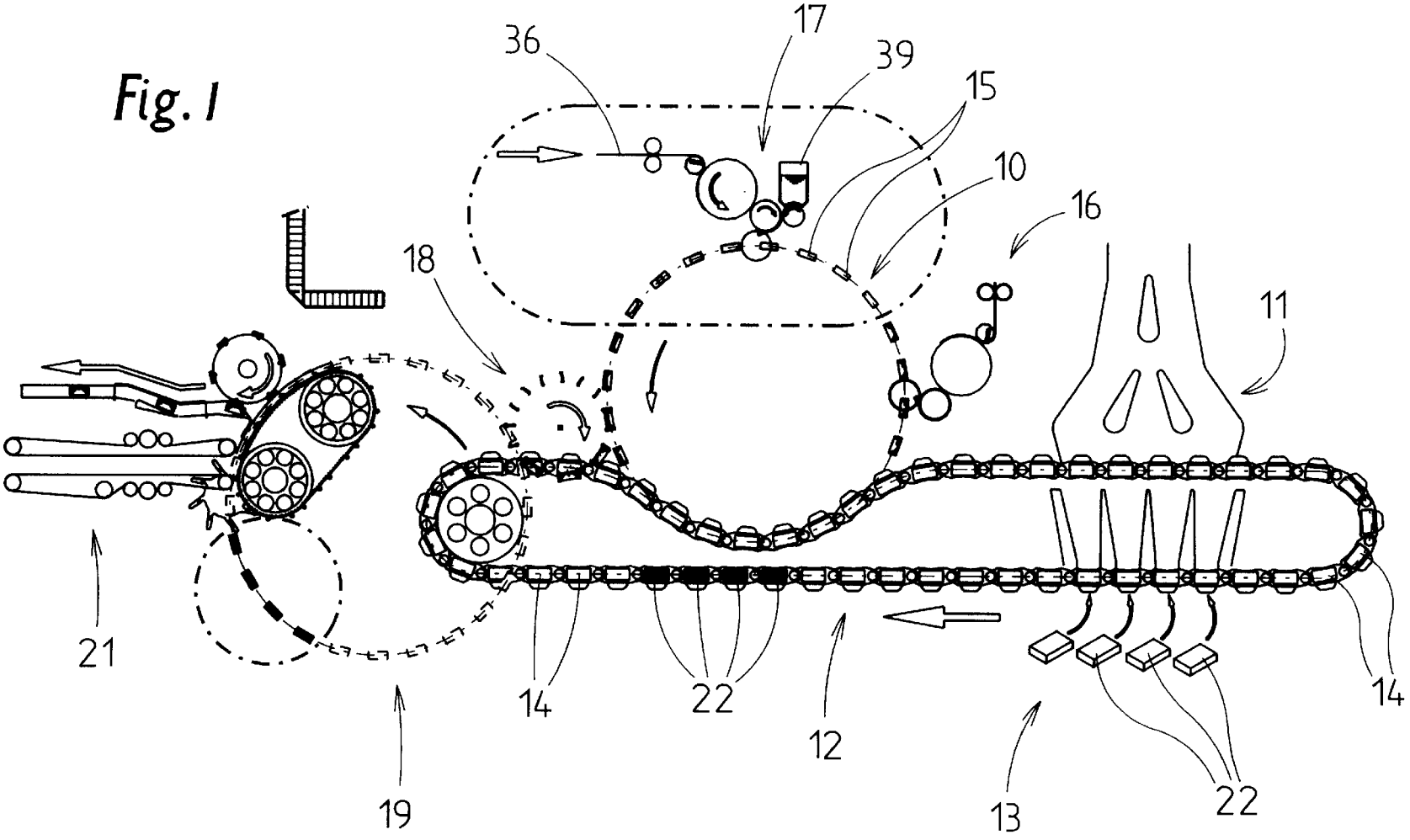
FIG. 1 shows a vastly simplified side view of a cigarette packaging machine.

FIG. 1 shows, as an advantageous exemplary embodiment, a schematic overview of a cigarette packaging machine for producing cigarette packs of the soft-carton type. The packaging machine is described in detail in U.S. Pat. No. 4,750,607. According to this document, the packaging machine comprises a central folding turret 10 to which cigarette groups are fed by a pocket conveyor 12. In the region of a charging station 13, the cigarette groups 11 are axially pushed out of a cigarette magazine and into pockets 14 of the pocket conveyor 12, said pockets being open at both ends. Details of the configuration of the pocket conveyor 12 can be gathered from U.S. Pat. No. 4,735,032.

The folding turret 10 has a multiplicity of circumferentially spaced-apart hollow bodies, namely so-called folding mandrels 15. Blanks of a cigarette pack which is to be produced are folded on the outside of said folding mandrels, namely, in the region of a first blank station 16, an inner wrapper made of paper or tin foil and, in the region of a second blank station 17, blanks of paper or similar material for forming the outer packaging, that is to say a soft carton. The cigarette group is introduced into the folding mandrels 15, which are open at both ends, in an axis-parallel direction in relation to the folding turret 10. Once the blanks have been folded on the outside of the folding mandrels 15, the cigarette group, together with the (folded) blanks, is pushed out of the folding mandrel 15 and/or away from the same.

Further on, the cigarette pack is completed by final folding steps and then transferred to a drying subassembly via a transfer turret 18, for example of the design according to EP 0 761 539. Said drying subassembly is a drying turret 19, expediently of the design according to U.S. Pat. No. 5,544,467.

In the region of the drying turret 19, it is intended to harden areas of glue of the cigarette pack in the region of the soft carton. Moreover, the (cuboidal) configuration of the cigarette pack is stabilized. For this purpose the folding turret comprises a plurality of axis-parallel drying shafts 20 which are arranged along the circumference and are in the cross-sectional shape of a cigarette pack. A plurality of, in the present case three, cigarette packs are arranged right up against one another in the longitudinal direction in the drying shaft 20. By virtue of a following cigarette pack being pushed in, a treated cigarette pack is pushed out on the opposite side. The cigarette packs passing out of the drying turret 19 are transported away via further conveying devices 21.

In order to clean a packaging machine designed, for example, in the manner described, cleaning elements and/or cleaning bodies are directed through the packaging machine instead of the cigarette groups and of the packaging material, that is to say blanks. The contact and the necessary movement of the cleaning elements and bodies relative to the devices or surfaces of the packaging machine bring about the cleaning, to be precise in particular by mechanical action (sliding, brushing) or by the action of suitable cleaning agents adhering to the cleaning bodies.

Figure 2:
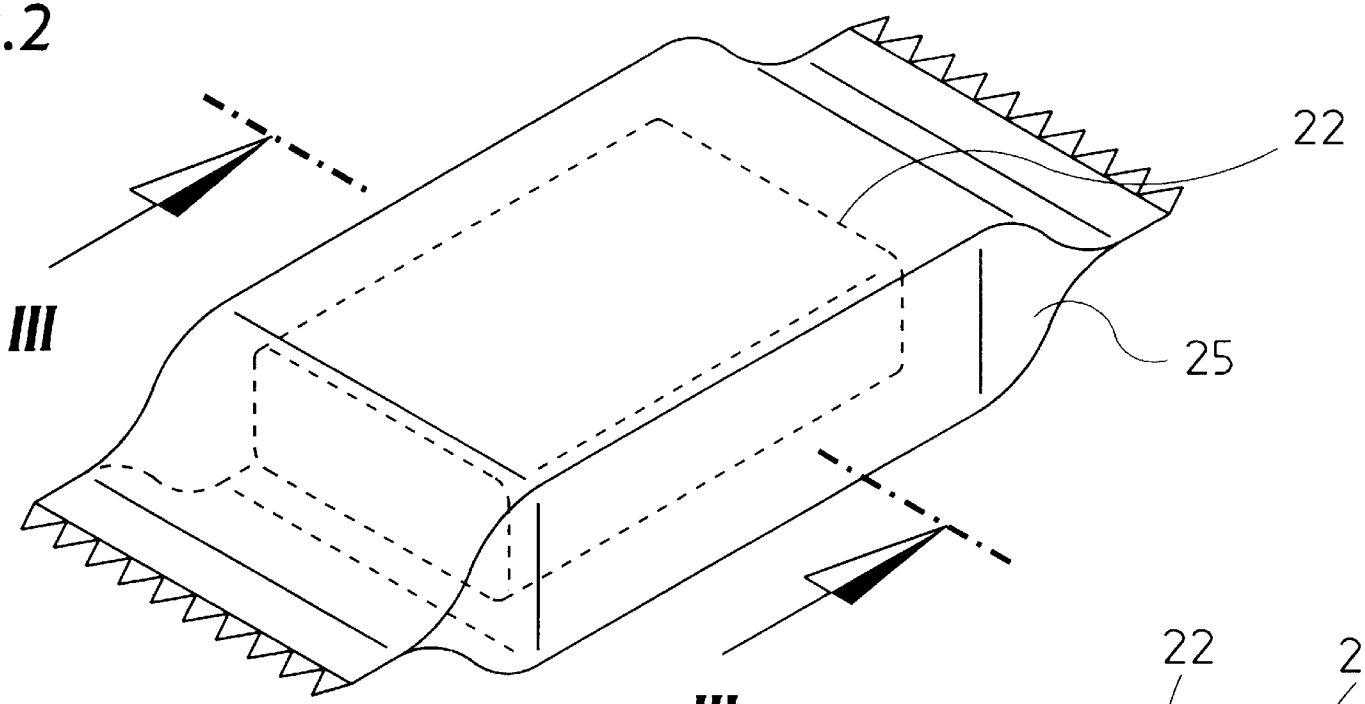
FIG. 2 shows a perspective illustration of a cleaning body in the packaged state.
Figure 3:
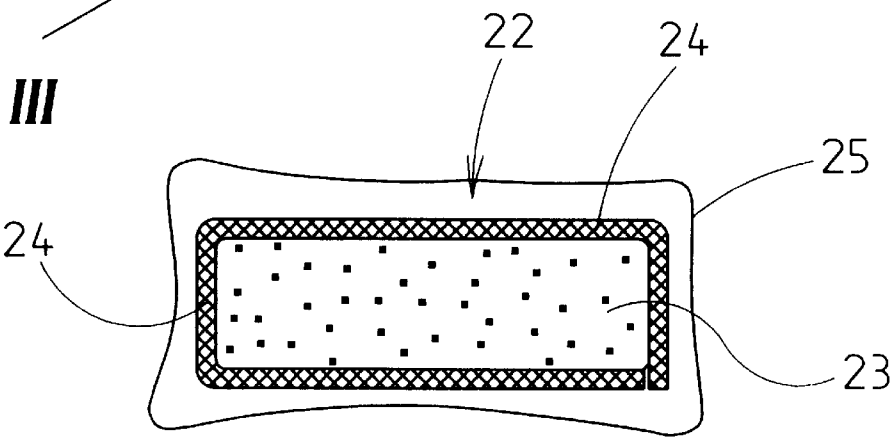
FIG. 3 shows a cross section of FIG. 2 along section plane III—III.

FIGS. 2 and 3 show, as an example, a cleaning body 22 which is of the dimensions of a cigarette pack or of a cigarette group wrapped in an inner blank, that is to say of the dimensions of a cigarette block. The cleaning body 22 consists of a compliant material, with the result that the compliance of the material means that the packaging machine is not damaged in the case of defects or catching. Accordingly, the cleaning body comprises a core 23 made of (rigid) foam, foam rubber or the like. The core 23 is encased by a possibly multi-layer covering 24. The latter consists of a nonwoven, felt or a so-called tissue material. The covering 24 is expediently impregnated or coated with a suitable cleaning agent.

The cleaning body 22 which has been prepared or pretreated for the cleaning process is provided in sealed packaging, in the present case in a foil-material tubular bag 25. This means that the cleaning body 22, possibly provided with cleaning agents, can be stored without the cleaning action being reduced. For use, the cleaning body 22 is removed from the tubular bag 25.

Figure 5:
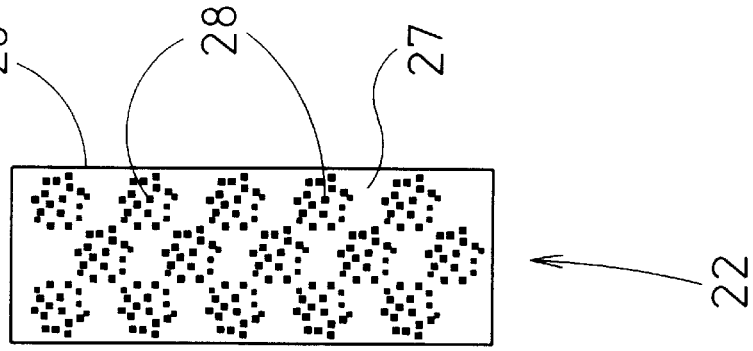
FIG. 5 shows an end view of the cleaning body according to FIG. 4.
Figure 4:
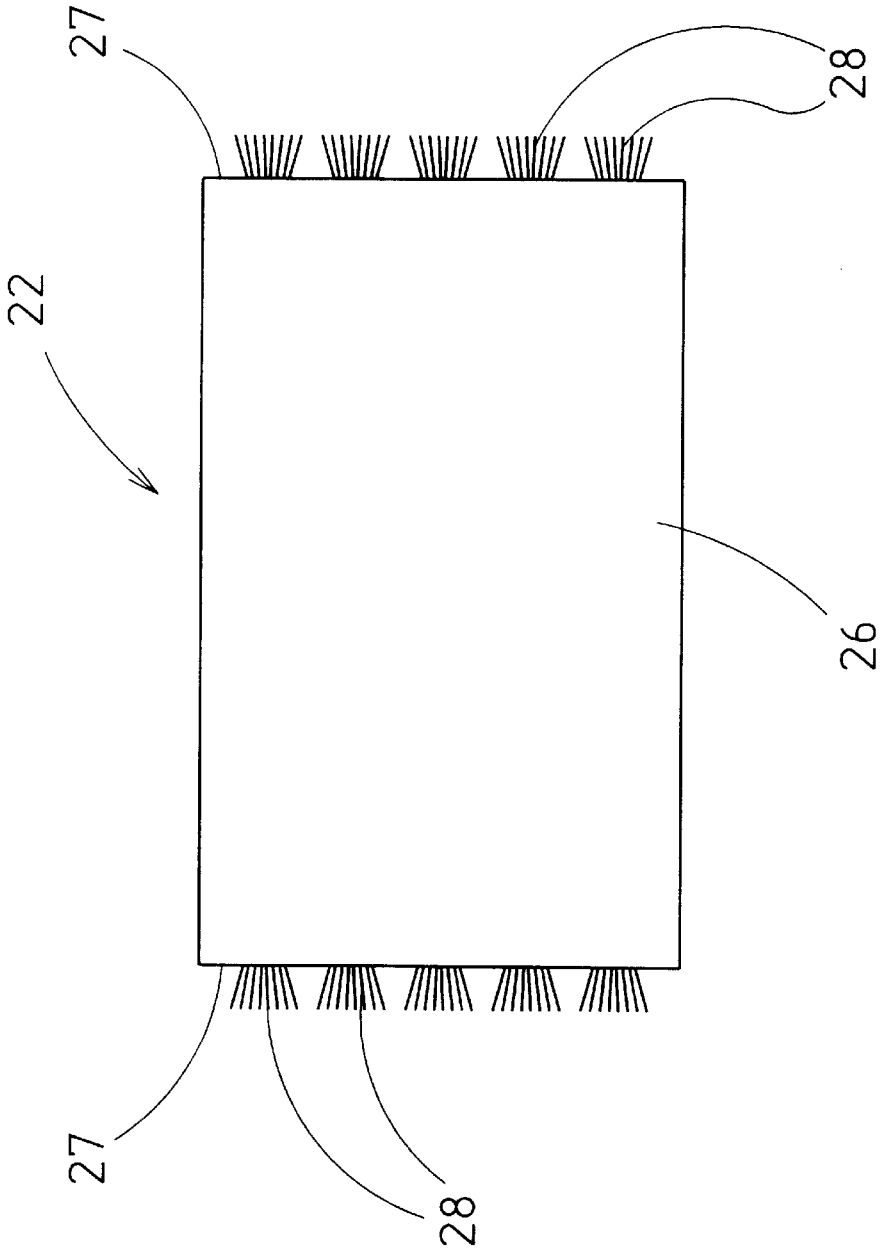
FIG. 4 shows a plan view of another cleaning body.

Another possible embodiment of a cleaning body 22 is shown in FIGS. 4 and 5. This cleaning body is a cuboidal block 26 which has mechanical cleaning means, namely brushes 28, on the outside, in the present case on small end surfaces 27. These brushes are positioned such that they act in a cleaning manner on lateral, fixed guide surfaces of the packaging machine.

Once the packaging machine has emptied, that is to say for example during a necessary interruption in operation, with a change in the type of pack which is to be produced, etc., the cleaning bodies 22 designed in the manner described above, or in some other manner, are introduced into the packaging machine for the purpose of carrying out the cleaning. According to FIG. 1, in the region of the charging station 13, the cleaning bodies 22 are introduced into the pocket conveyor 12 or into the pockets 14 instead of cigarette groups. The functional sequences of the packaging machine during the production of cigarette packs are taken into account here. For this reason, four cleaning bodies 22 are introduced into pockets 14 in each case. The rest of the pockets 14 remain empty.

In the same way as cigarette groups 11, the cleaning bodies 22 are fed to the folding turret 10 and transferred to the same. In this case, the cleaning bodies 22 are pushed into the folding mandrels 15 and out of the same again in accordance with the functional sequence. Furthermore, the cleaning bodies 22 are fed to the drying turret 19 via the transfer turret 18 and pushed through the drying shafts 20.

Figure 6:
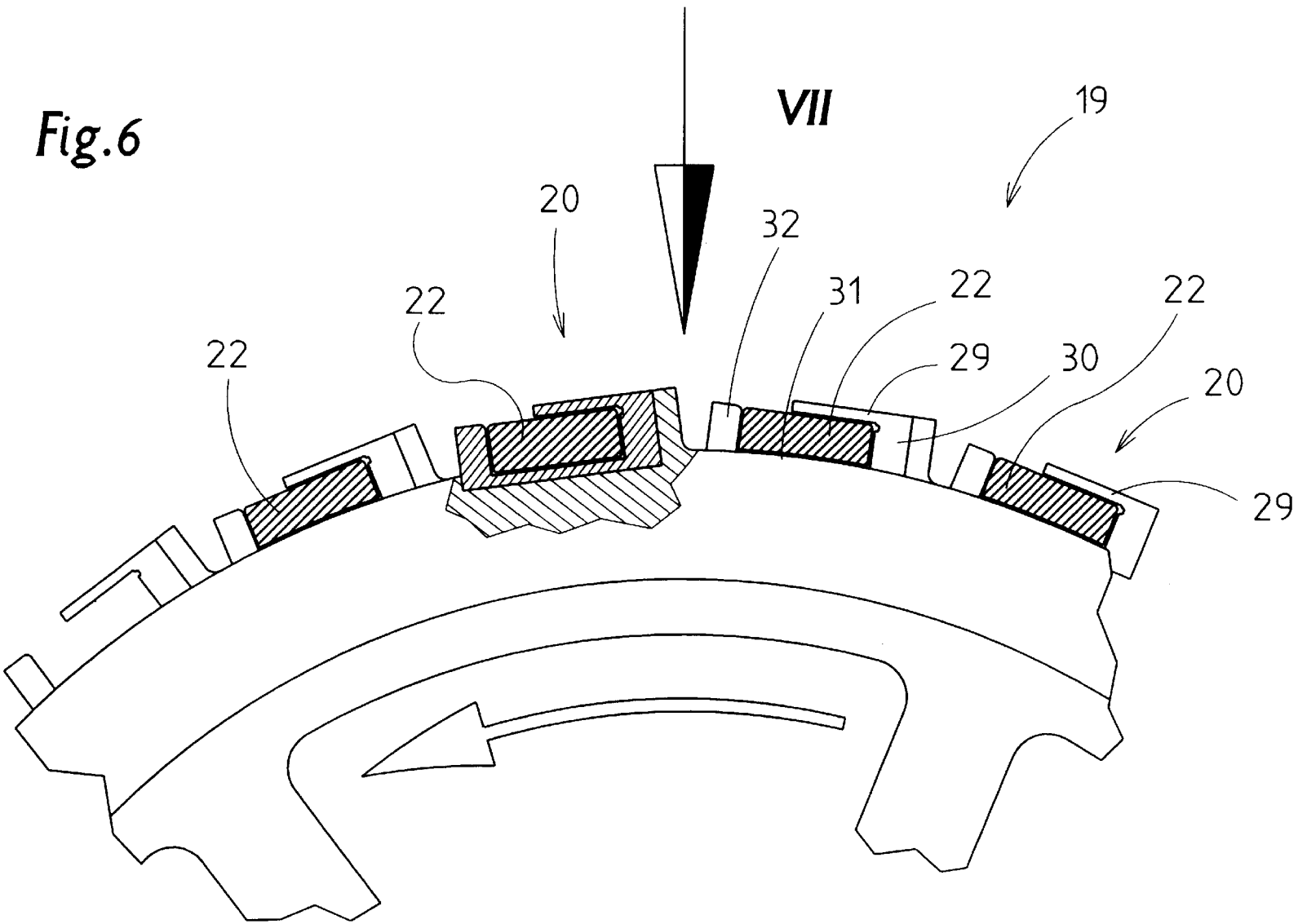
FIG. 6 shows a detail of a turret, namely of a drying turret of a cigarette packaging machine, partially in radial section.
Figure 7:
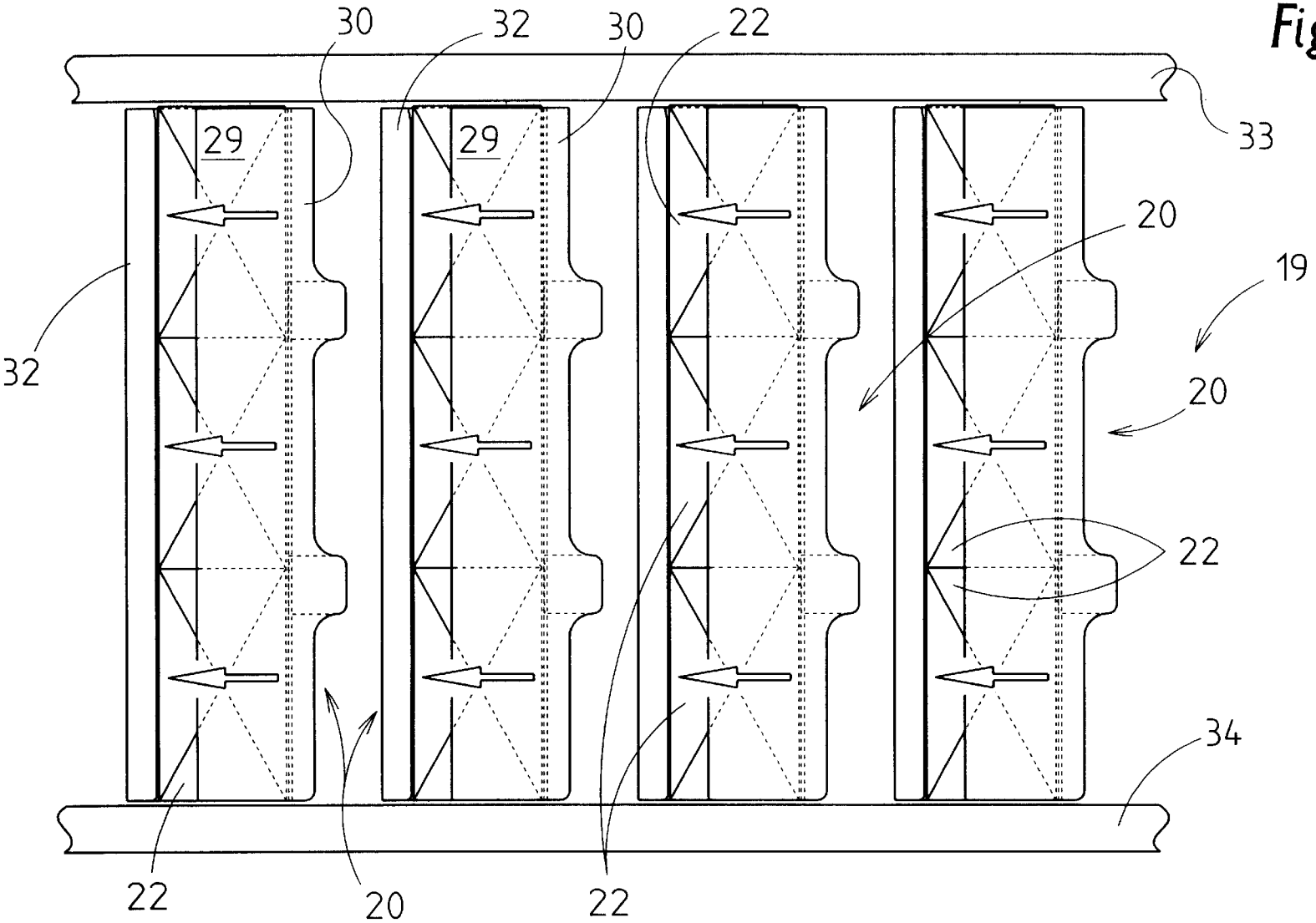
FIG. 7 shows the detail of the drying turret in a radially directed view in accordance with arrow VII of FIG. 6.

The cleaning method is implemented here such that a plurality of cleaning phases are used for the purpose of cleaning the entire drying turret 19. The operation of charging with cleaning bodies 22 is selected here such that one after the other four circumferentially adjacent drying shafts 20 are charged in their entirety with (in each case three) cleaning bodies 22. For this purpose, in each case groups of four cleaning bodies 22 can be introduced, in the region of the charging station 13, at such distances apart from one another that the respectively four cleaning bodies are distributed one after the other to the same drying shafts 20 of the drying turret 19 (FIGS. 6 and 7). The drying shafts 20 are cleaned over their entire length by the sliding movement of the cleaning bodies 22 pushed through them, that is to say shaft walls 29, 30, 31, 32 in particular are cleaned. Furthermore, lateral guide walls 33, 34 of the drying turret 19 are also cleaned by virtue of end surfaces of the cleaning bodies 22 sliding past them.

In order to achieve an additional cleaning effect or to include other devices of the packaging machine, it is provided that in addition, or as an alternative, cleaning blanks 35—instead of blanks of packaging material—are directed through the packaging machine. The cleaning blanks 35 are designed and/or pretreated so as to achieve a cleaning effect, in particular by being impregnated or coated with a cleaning agent.

In the case of the present exemplary embodiment, the cleaning blanks 35 are fed via the blank stations 16, 17, in the present case by way of the blank station 17. The cleaning blanks 35 are severed from a continuous material web 36 and transferred to the folding turret 10 or a folding mandrel 15 via a feed roller 37. The cleaning blanks 35 are fed by the same devices which also transfer the packaging blanks, that is to say for example by a transfer device 38 of the design according to EP 0 839 719. In this case, the cleaning blank 35 is positioned on the outside of the folding mandrel 15 and folded around the latter. A cleaning body 22 is expediently located within the folding mandrel 15. In the same way as a cigarette pack, the cleaning body 22 is pushed out of the folding mandrel 15 at the envisaged position, the cleaning blank 35 provided on the outside of the folding mandrel 15 being carried along in the process. For carrying-along purposes, said cleaning blank is folded, but not glued, in the region of a side corresponding to a base wall of the cigarette pack. In this case, the cleaning blank 35 also runs through the drying turret 19 together with the cleaning body 22.

Preparation of the cleaning blank 35 for the cleaning operation, that is to say in particular coating or impregnation with a cleaning agent, takes place in the region of the blank station 17. A container 39 with a suitable cleaning fluid is provided for this purpose. A removal device, namely a removal roller 40, removes a layer of the cleaning agent from the container 39 and transfers it, by contact, to the outside of the cleaning blank 35. In the present case, the removal roller 40 is assigned to the feed roller 37, with the result that the coating or impregnation is carried out immediately before the cleaning blank 35 is introduced into the packaging machine.

Figure 9:
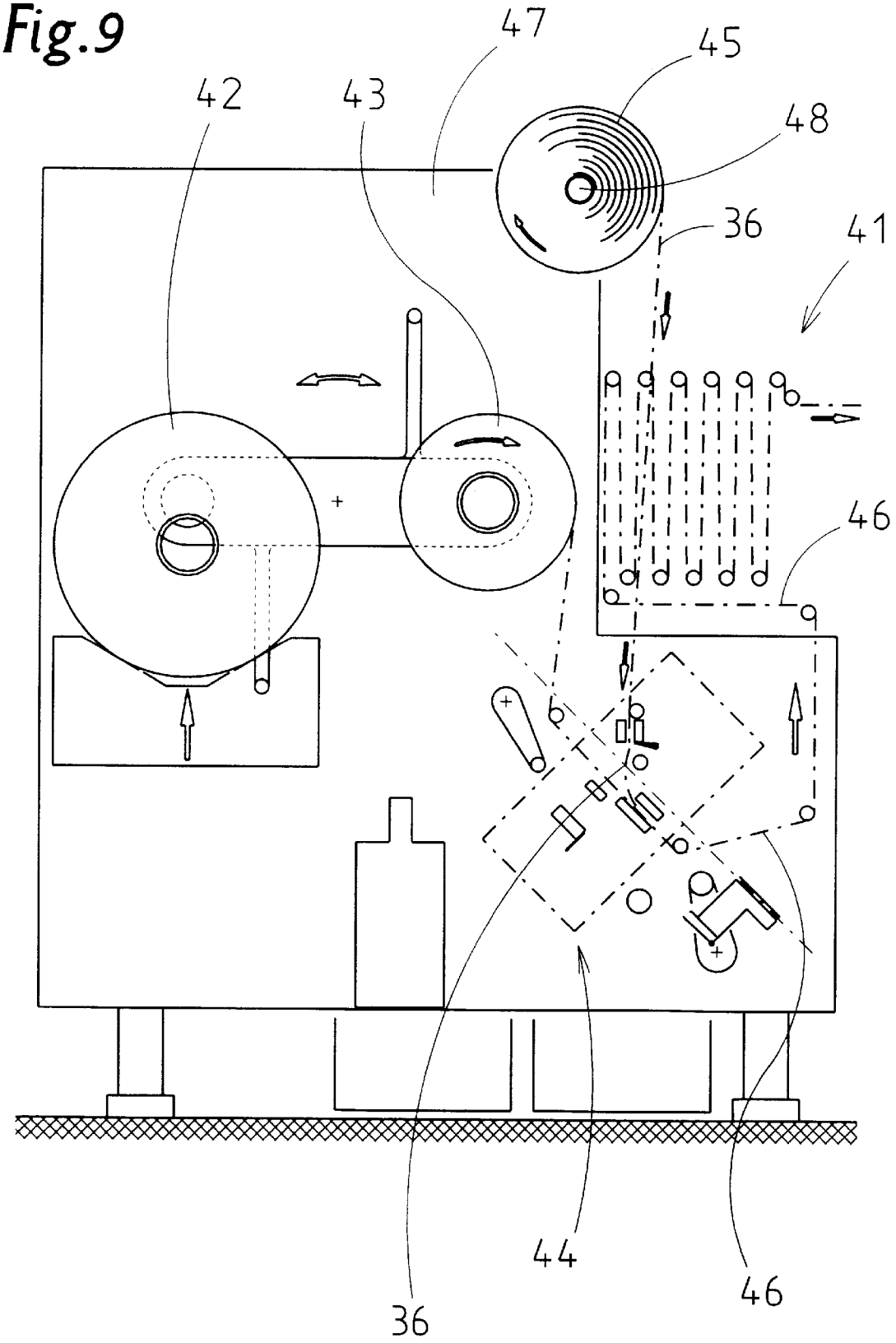
FIG. 9 shows a simplified side view of a further detail of a packaging machine, namely a web connector.

The packaging machine is expediently assigned a web-connection subassembly, namely a splicing subassembly 41 (FIG. 9). In the present case, this subassembly is designed in accordance with DE 198 04 614.6. According to this document, reels 42, 43 are made available. Once the reel 43 has been used up, the reel 42 is to be connected to a finishing material web. The connection is carried out automatically by a splicing unit 44.

Figure 8:
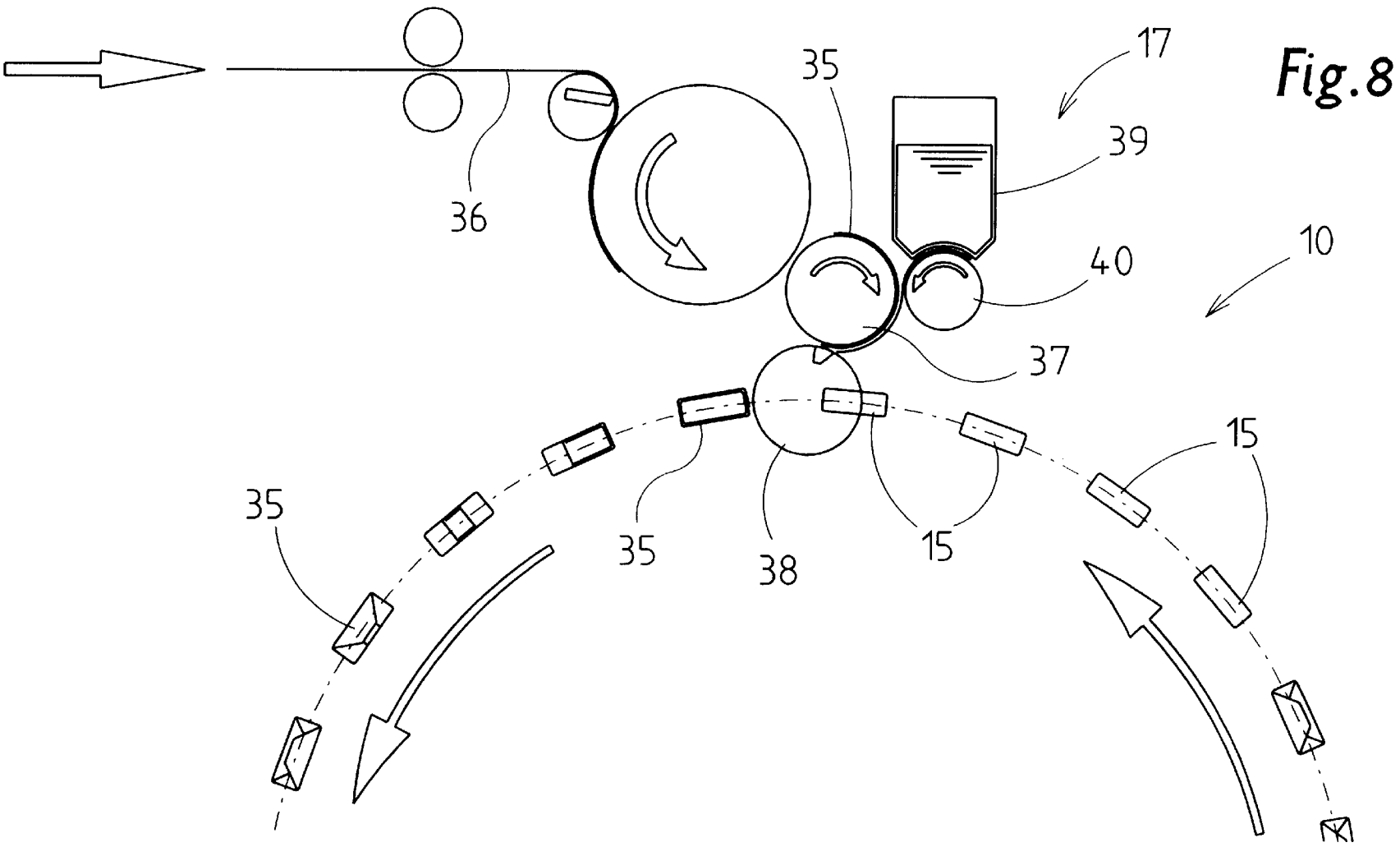
FIG. 8 shows, on an enlarged scale, a side view of a detail of a folding turret of the packaging machine according to FIG. 1.

The splicing subassembly 41 also accommodates a reel 45 for the material web 36 for producing the cleaning blanks 35. The splicing subassembly 41 is designed such that, when the packaging machine is emptied, the web 36 of the cleaning material is connected to a finishing web 46 of the packaging material. According to the example of FIG. 8, this web 46 is a paper web, to which the material web 36, which likewise consists of paper or a paper-like material, is automatically connected with the aid of the splicing unit 44. For this purpose, the reel 45 is provided, above the splicing unit 44, on a common carrying framework 47. The reel 45 is positioned—in a manner analogous to the reels 42, 43—on a carrying stub 48.

When use is made of a cleaning body 22 of the design according to FIGS. 4 and 5, the (additional) use of the cleaning blanks 35 is dispensed with.

LIST OF DESIGNATIONS

10 Folding turret
11 Cigarette magazine
12 Pocket conveyor
13 Charging station
14 Pocket
15 Folding mandrel
16 Blank station
17 Blank station
18 Transfer turret
19 Drying turret
20 Drying shaft
21 Conveying device
22 Cleaning body
23 Core
24 Covering
25 Tubular bag
26 Block
27 End surface
28 Brush
29 Shaft wall
30 Shaft wall
31 Shaft wall
32 Shaft wall
33 Guide wall
34 Guide wall
35 Cleaning blank
36 Material web
37 Feed roller
38 Transfer device
39 Container
40 Removal roller
41 Splicing subassembly
42 Reel
43 Reel
44 Splicing unit
45 Reel
46 Web
47 Carrying framework
48 Carrying stub

What is claimed is:

1. A method of cleaning packaging machines which produce packs containing contents, each machine having a pocket conveyor (12), a folding turret (10) and a drying turret (19), wherein the pack contents and blanks of the packaging machine run through the packaging machine to produce the packs, said method comprising, the steps of:

conveying essentially cuboidal cleaning bodies (22) through the packaging machine instead of the pack contents;

transporting the essentially cuboidal cleaning bodies (22) through the pocket conveyor (12), transferring them to folding mandrels (15) of the folding turret (10), and pushing them inside the folding mandrels (15);

folding a cleaning blank (35) on the outside of at least one of the folding mandrels;

removing from the folding mandrel (15) a unit comprising a cleaning body (22) and the cleaning blank (35); and feeding the unit to the drying turret (19).

2. A method of cleaning packaging machines which produce packs containing contents, each machine having a pocket conveyor (12), a folding turret (10) and a drying turret (19), wherein the pack contents and blanks of the packaging machine run through the packaging machine to produce the packs, said method comprising the steps of:

conveying essentially cuboidal cleaning bodies (22) through the packaging machine instead of the pack contents;

during an interruption phase in the production of packs, introducing the cleaning bodies (22) into the packaging machine in groups, such that a plurality of circumferentially adjacent drying shafts (20) of the drying turret (19) are completely filled one after the other with the cleaning bodies (22); and in a following cleaning phase, filling other adjacent drying shafts (20) with cleaning bodies (22) one after the other.

3. A method of cleaning packaging machines which produce packs containing contents, each machine having a pocket conveyor (12), a folding turret (10) and a drying turret (19), wherein the pack contents and blanks of the packaging machine run through the packaging machine to produce the packs, said method comprising the steps of:

conveying essentially cuboidal cleaning bodies (22) through the packaging machine instead of the pack contents;

providing each of the cuboidal cleaning bodies (22) as a deformable core encased by a covering (24) made of absorbent material.

4. A method of cleaning packaging machines which produce packs containing contents, each machine having a pocket conveyor (12), a folding turret (10) and a drying turret (19), wherein the pack contents and blanks of the packaging machine run through the packaging machine to produce the packs, said method comprising the steps of:

conveying essentially cuboidal cleaning bodies (22) through the packaging machine instead of the pack contents;

severing cleaning blanks (35) from a web (36) of material; and coating or impregnating the cleaning blanks (35) with a cleaning agent before transferring them to the folding turret (10).

5. A method of cleaning packaging machines which produce packs containing contents, each machine having a pocket conveyor (12), a folding turret (10) having folding mandrels, and a drying turret (19), wherein the pack contents and pack blanks of packaging material run through the packaging machine to produce the packs, said method comprising the steps of:

a) conveying cuboidal cleaning bodies (22) through the packaging machine instead of the pack contents;

b) configuring the cuboidal cleaning bodies (22) essentially to conform to the shape and dimensions of the pack contents; and c) providing the cuboidal cleaning bodies (22) with outer cleaning surfaces which butt against surfaces of pockets of the pocket conveyor (12), folding turret (10) and drying turret (19).

6. The method according to claim 5, further comprising the steps of:

transporting the cuboidal cleaning bodies (22) through the pocket conveyor (12), transferring them to the folding turret (10), and pushing them inside the folding mandrels (15);

folding a cleaning blank on the outside of at least one of the folding mandrels (15);

drawing off of the folding mandrel a unit consisting of the cleaning body (22) and cleaning blank (35); and feeding the unit to the drying turret (19).

7. The method according to claim 6, further comprising the steps of:

severing the cleaning blank (35) from a web (36) of material; and coating or impregnating the cleaning blank (35) with a cleaning agent before transferring the cleaning blank (35) to the folding turret (10).

8. The method according to claim 5, further comprising the steps of:

during an interruption phase in the production of the packs, introducing the cuboidal cleaning bodies (22) into the packaging machine in groups in such a manner that a plurality of circumferentially adjacent drying shafts (20) of the drying turret (19) are completely filled one after the other with the cleaning bodies (22); and in a following cleaning phase, also filling other circumferentially adjacent drying shafts (20) of the drying turret (19) with cleaning bodies (22) one after the other.

9. The method according to claim 5, further comprising the step of providing each of the cuboidal cleaning bodies (22) as a deformable core encased in a covering (24) of absorbent material.

* * * * *